US009803899B2

(12) United States Patent
Sedlak et al.

(10) Patent No.: US 9,803,899 B2
(45) Date of Patent: Oct. 31, 2017

(54) CONDENSER, METHOD FOR CONDENSING, AND HEAT PUMP

(71) Applicant: Efficient Energy GmbH, Feldkirchen (DE)

(72) Inventors: Holger Sedlak, Lochhofen / Sauerlach (DE); Oliver Kniffler, Sauerlach (DE)

(73) Assignee: Efficient Energy GmbH, Feldkirchen (DE)

( * ) Notice: Subject to any disclaimer, the term of this patent is extended or adjusted under 35 U.S.C. 154(b) by 187 days.

(21) Appl. No.: 14/703,526

(22) Filed: May 4, 2015

(65) Prior Publication Data

US 2015/0233618 A1 Aug. 20, 2015

Related U.S. Application Data

(63) Continuation of application No. PCT/EP2013/072900, filed on Nov. 4, 2013.

(60) Provisional application No. 61/722,978, filed on Nov. 6, 2012.

(30) Foreign Application Priority Data

Nov. 6, 2012 (DE) ..... 10 2012 220 199

(51) Int. Cl.
*F25B 1/00* (2006.01)
*F25B 39/04* (2006.01)
*F25B 30/02* (2006.01)

(52) U.S. Cl.
CPC ..... *F25B 39/04* (2013.01); *F25B 30/02* (2013.01); *Y10T 29/4935* (2015.01)

(58) Field of Classification Search
CPC ..... F25B 1/10; F25B 13/00; Y02B 30/12
USPC ..... 62/324.1, 498, 238.6
See application file for complete search history.

(56) References Cited

U.S. PATENT DOCUMENTS

| | | | | |
|---|---|---|---|---|
| 2,389,005 | A | 11/1945 | Sebald | |
| 4,282,348 | A | 8/1981 | Wada et al. | |
| 5,558,818 | A | 9/1996 | Gohara et al. | |
| 2004/0093876 | A1* | 5/2004 | Inagaki | B01J 20/0292 62/112 |
| 2011/0107787 | A1* | 5/2011 | Sedlak | F24H 4/04 62/434 |

FOREIGN PATENT DOCUMENTS

| | | | |
|---|---|---|---|
| CN | 1698922 | A | 11/2005 |
| DE | 53586 | A | 9/1890 |
| DE | 2714685 | A1 | 10/1977 |

(Continued)

OTHER PUBLICATIONS

Office Action and Search Report in co-pending Chinese Application No. 2015-541090 dated Apr. 5, 2016 (11 pages).

(Continued)

*Primary Examiner* — Melvin Jones
(74) *Attorney, Agent, or Firm* — Haynes and Boone, LLP

(57) ABSTRACT

A condenser includes a condensation zone for condensing vapor to be condensed in an operating liquid, the condensation zone being formed as a volume zone including a top end, a bottom end and a lateral boundary between the top end and the bottom end, and a vapor introduction zone extending along the lateral end of the condensation zone and being configured to feed vapor to be condensed into the condensation zone laterally via the lateral boundary.

20 Claims, 7 Drawing Sheets

(56) References Cited

FOREIGN PATENT DOCUMENTS

| | | | |
|---|---|---|---|
| DE | 221539 | A1 | 4/1985 |
| DE | 3916073 | C1 | 8/1990 |
| DE | 4308137 | A1 | 9/1994 |
| DE | 4308137 | A1 | 9/1994 |
| EP | 2016349 | B1 | 5/2011 |
| FR | 1035903 | A | 9/1953 |
| GB | 121575 | A | 12/1918 |
| JP | 5413805 | A | 2/1979 |
| JP | 55152384 | A | 11/1980 |
| JP | 58220908 | A | 12/1983 |
| JP | 0666485 | A | 3/1994 |
| JP | 08158811 | A | 6/1996 |
| JP | 2000084383 | A | 3/2000 |
| JP | 2003207287 | A | 7/2003 |
| JP | 2004293872 | A | 10/2004 |
| JP | 2005305437 | A | 11/2005 |
| JP | 2009532655 | A | 9/2009 |
| JP | 2011127754 | A | 6/2011 |
| JP | S5941105 | B2 | 10/2014 |
| WO | WO-2007/118482 | A1 | 10/2007 |

OTHER PUBLICATIONS

Chinese Office Action dated Jun. 29, 2016 issued in parallel Chinese application No. 2013800694302 (12 pages with English translation).

International Search Report in related PCT Application No. PCT/EP2013/072900 dated Mar. 21, 2014 (5 pages).

Office action dated Jan. 4, 2017 issued in co-pending Japanese App. No. 2015-541090 (6 pages with English translation).

* cited by examiner schematic view of the lid from below

| P[hPa] | 8 | 12 | 30 | 60 | 100 | 1000 |
|---|---|---|---|---|---|---|
| evap. temp. | 4°C | 12°C | 24°C | 36°C | 45°C | 100°C |

CONDENSER, METHOD FOR CONDENSING, AND HEAT PUMP

CROSS-REFERENCE TO RELATED APPLICATIONS

This application is a continuation of copending International Application No. PCT/EP2013/072900, filed Nov. 4, 2013, which is incorporated herein by reference in its entirety, and additionally claims priority from U.S. Application No. 61/722,978, filed Nov. 6, 2012, and German Application No. 102012220199.8, filed Nov. 6, 2012, both of which are also incorporated herein by reference in their entirety.

The present invention relates to heat pumps for heating, cooling or for any other application of a heat pump and, in particular, to condensers for heat pumps of this kind.

BACKGROUND OF THE INVENTION

FIGS. 5A and 5B represent a heat pump as is illustrated in the European patent EP 2016349 B1. FIG. 5A shows a heat pump which comprises at first a water evaporator 10 for evaporating water as an operating liquid so as to generate a vapor in an operating vapor line 12 on the output side. The evaporator includes an evaporation space (not shown in FIG. 5A) and is configured to produce in the evaporation space an evaporation pressure of less than 20 hPa, so that the water evaporates in the evaporation space at temperatures below 15° C. The water is advantageously ground water, brine circulating in the ground soil in an unconfined manner or in collector tubes, i.e. water with a certain salt content, river water, lake water or sea water. In accordance with the invention, all types of water, i.e. limy water, lime-free water, saline water or salt-free water, may advantageously be used. The reason for this is that all types of water, i.e. all these "water substances", exhibit a favorable characteristic of water, namely the fact that water, which is also known under "R 718", comprises an enthalpy difference ratio of 6, which may be made use of for the heat pump process, which is more than 2 times the typical useful enthalpy difference ratio of, for example, R134a.

The water vapor is fed via the suction line 12 to a compressor/condenser system 14 which comprises a flow machine, such as, for example, a centrifugal compressor, exemplarily in the form of a turbo compressor, which in FIG. 5A is designated by 16. The flow machine is configured to compress the operating vapor to a vapor pressure of at least more than 25 hPa. 25 hPa corresponds to a condensing temperature of about 22° C., which, at least on relatively warm days, may already be a sufficient heating flow temperature for underfloor heating. In order to generate higher flow temperatures, pressures of more than 30 hPa may be generated for the flow machine 16, a pressure of 30 hPa corresponding to a condensing temperature of 24° C., a pressure of 60 hPa corresponding to a condensing temperature of 36° C., and a pressure of 100 hPa corresponding to a condensing temperature of 45° C. Underfloor heating systems are designed to be able to provide, even on very cold days, a sufficient degree of heating using a flow temperature of 45° C.

The flow machine is coupled to a condenser 18 which is configured to condense the compressed operating vapor. By means of condensing, the energy contained in the operating vapor is fed to the condenser 18 in order to be then fed to a heating system via the advance element 20*a*. The operating fluid flows back to the condenser via the return element 20*b*.

In accordance with the invention, it is advantageous to withdraw heat (energy) from the water vapor rich in energy by the cooler heating water directly, the heat (energy) being absorbed by the heating water such that same will heat up. An amount of energy is withdrawn from the vapor such that the same is condensed and also participates in the heating cycle.

This means that an introduction of material into the condenser or heating system takes place, which is regulated by an outlet 22 such that the condenser in its condensing space has a water level which, despite continuously feeding water vapor and, thus, condensate, will usually remain below a maximum level.

As has already been explained, it is advantageous to use an open cycle, i.e. evaporating water, which represents the source of heat, directly without a heat exchanger. Alternatively, the water to be evaporated could, however, also be heated up at first by an external heat source using a heat exchanger. However, it may be kept in mind here that said heat exchanger also entails losses and apparatus complexity.

Additionally, it is advantageous, in order to avoid losses for the second heat exchanger, which up to now is usually present on the condenser side, to use the medium there directly, too, i.e. when taking the example of a house featuring underfloor heating, having the water coming from the evaporator circulate directly in the underfloor heating.

Alternatively, a heat exchanger may be arranged on the condenser side, which is fed by the advance element 20*a* and comprises the return element 20*b*, wherein said heat exchanger cools the water in the condenser and thus heats up a separate underfloor heating liquid which will typically be water.

Due to the fact that water is used as the operating medium, and due to the fact that only the evaporated part of the ground water is fed to the flow machine, the degree of purity of the water is not important. The flow machine is, as is the condenser and, perhaps, the directly coupled underfloor heating, usually supplied with distilled water such that, compared to present systems, the system entails reduced servicing. In other words, the system is self-cleaning since the system is usually supplied with distilled water only, which means that the water in the outlet 22 is not polluted.

Additionally, it is to be pointed out that flow machines exhibit the characteristic—similarly to a plane's turbine—of not bringing the compressed medium into contact with problematic substances, such as, for example, oil. Instead, the water vapor is compressed only by the turbine or the turbo compressor, but not brought into contact and, thus, polluted with oil or another medium affecting purity.

When there are no other restricting rules, the distilled water discharged by the outlet may then be easily fed again to the ground water. Alternatively, it may, for example, also be seeped in the garden or in an open area, or it may be fed to a water treatment plant via a channel, if rules call for this.

By the combination of water as an operating medium featuring a useful enthalpy difference ratio which is two times better compared to R134a and the consequently reduced requirements to the system being closed (rather, an open system is advantageous), and by using the flow machine, by means of which the compressing factors that may be used are achieved efficiently and without affecting purity, what is achieved is an efficient and environmentally neutral heat pump process which becomes even more efficient when the water vapor is condensed directly in the condenser, since not a single heat exchanger will be required for the entire heat pump process.

FIG. 5B shows a table for illustrating different pressures and evaporating temperatures associated to said pressures, the result being that, in particular for water as an operating medium, relatively low pressures are to be chosen in the evaporator.

In order to achieve a heat pump of high efficiency, it is important for all the components, i.e. the evaporator, the condenser and the compressor, to be designed to be favorable.

DE 4431887 A1 discloses a heat pump system comprising a light-weight large-volume high-power centrifugal compressor. Vapor leaving a compressor of a second stage comprises a saturation temperature which exceeds the surrounding temperature or that of the cooling water available, thereby allowing heat discharge. The compressed vapor is transferred from the compressor of the second stage to the condenser unit which consists of a packed bed provided within a cooling water spraying means on a top, which is supplied by a water circulation pump. The compressed water vapor rises through the packed bed in the condenser where it is in direct counter-flow contact with the cooling water flowing downwards. The vapor condenses and the latent heat of the condensation which is absorbed by the cooling water is emitted to the atmosphere via the condensate and the cooling water which together are discharged from the system. The condenser is rinsed continuously with non-condensable gases, by means of a vacuum pump via a pipeline.

A condenser in which cooling water is in direct counter-flow contact with the condensing vapor, in which the angle between the direction of cooling water on the one hand and the vapor on the other hand is 180 degrees, is of disadvantage in that condensation is not distributed optimally over the volume of the condenser. Condensation here will usually take place only at the interface between water and vapor, which is defined by the cross-section of the condenser. In order to produce a greater condensing performance, the cross-section of the condenser has to be enlarged, or other parameters may be changed, such as, for example, flow through the condenser, vapor pressure in the condenser, etc., which are all problematic on the one hand and, on the other hand, result in an undesired enlargement of the entire system, in particular with regard to enlarging the condensing cross-section. If, however, on the other hand, the system is not enlarged, the result will be that the entire heat pump including a condenser operating in a counter-flow direction does not achieve a performance coefficient which may be used for certain applications where, however, the situation with regard to space is such that enlarging the system has to be ruled out.

SUMMARY

According to an embodiment, a condenser may have: a condensation zone for condensing vapor to be condensed in an operating liquid, the condensation zone being implemented as a volume zone including a top end, a bottom end and a lateral boundary between the top end and the bottom end; a vapor introduction zone which extends along the lateral end of the condensation zone and is configured to feed vapor to be condensed into the condensation zone laterally via the lateral boundary; and a condenser casing, wherein a region in the condenser casing is limited by a cage-like boundary object spaced apart from the condenser casing by a distance, wherein the vapor introduction zone is arranged in the distance, and wherein the condensation zone is arranged in the region limited by the cage-like boundary object.

Another embodiment may have a method of using a condenser in accordance with claim 1, wherein a flow of operating liquid takes place in the condensation zone in an advantageous direction and wherein operating liquid vapor enters into the condensation zone from the vapor introduction zone in a cross-flow manner, wherein a flow direction of the operating liquid vapor forms an angle with regard to the advantageous direction of the operating liquid flow which is greater than 10 degrees and smaller than 170 degrees.

According to another embodiment, a method for manufacturing a condenser may have the steps of: providing a condensation zone for condensing vapor to be condensed in an operating liquid, the condensation zone being implemented as a volume zone including a top end, a bottom end and a lateral boundary between the top end and the bottom end; arranging a vapor introduction zone along the lateral end of the condensation zone so that vapor to be condensed is fed into the condensation zone laterally via the lateral boundary and wherein a region in a condenser casing is limited by a cage-like boundary object spaced apart from the condenser casing by a distance, wherein the vapor introduction zone is arranged in the distance, and wherein the condensation zone is arranged in the region limited by the cage-like boundary object.

According to another embodiment, a heat pump may have: an evaporator for evaporating operating liquid; a compressor for compressing operating liquid evaporated in the evaporator; and a condenser in accordance with claim 1, the vapor introduction zone being connected to an output of the compressor.

The present invention is based on the finding that the condensation zone of a condenser on the one hand and the vapor inlet zone of the condenser on the other hand are to be implemented relative to each other such that the vapor to be condensed enters the condensation zone laterally. Thus, without enlarging the volume of the condenser, the actual condensation is made a volume condensation since the vapor to be condensed is not only introduced into a condensation volume or the condensation zone head-on from one side, but laterally and, advantageously, from all sides. This does not only ensure that the condensation volume made available, with equal external dimensions, is enlarged when compared to direct counter-flow condensation, but that at the same time the efficiency of the condenser is improved for another reason.

This reason is that the vapor to be condensed in the condensation zone exhibits a flow direction transverse to a flow direction of the condensation liquid. Thus, the advantageous direction of the vapor to be condensed is not either parallel to the advantageous direction of the operating liquid or anti-parallel to the advantageous direction of the operating liquid, but transverse thereto. This ensures making better use of the condensation volume made available. Additionally, it has been found out that a transverse flow can be achieved already by the fact that the vapor enters the condensation zone laterally.

The vapor flow is redirected already due to the mechanism of action of condensation. Due to the surrounding conditions in the condenser, the vapor particles here are "sucked in" by the liquid particles. Redirecting thus is already part of the condensation process which here takes place as a kind of "preliminary stage" of the actual transfer of heat to the operating liquid. It has been found out that "sucking in" vapor into the condenser volume is such a vigorous process that an efficient transverse flow of the vapor in the condensation zone is produced such that the vapor may be introduced into the condensation zone almost in parallel to the direction of the operating liquid. However, due to the lateral introduction, redirecting takes place directly where the condensation zone begins or when the vapor comes close to the condensation zone such that the desired transverse flow direction in the condensation zone is achieved. As has been explained, this is achieved by the vapor not being introduced into the condensation zone head-on, but laterally and, advantageously, completely circumferentially. Additionally, it has been found out that an additional introduction on one of the two front sides of the condensation zone is not absolutely necessary and, thus, does not necessarily have to take place if this is of constructive usefulness. Introducing the vapor into the condensation zone laterally is so effective that an additional introduction at the top and/or bottom boundary of the condensation zone is not absolutely necessary, but may take place if the construction makes it possible.

In the advantageous embodiment of the present invention, the condensation zone is formed by liquid drops trickling, in the condensation zone, from the top to the bottom, mainly due to gravity. The introduction of vapor here takes place in a region separate from the generation of the water drops. In one embodiment, the water drops are generated by a perforated plate at the top of the condensation zone and the vapor is introduced in a region outside of where the liquid drops are generated.

In another embodiment of the present invention, the condensation zone is filled with fillers, such as, for example, Pall rings, wherein particularly fillers of a relatively large surface which are applied loosely in the condensation zone are advantageous so as to cause redirection or turbulence in the liquid in the condensation zone such that vapor not yet condensed will usually find a rather cool area of the condensation liquid and condense there efficiently.

In another embodiment of the present invention, the lateral vapor introduction zone is limited downwards in that there are also filling particles which, due to the processes in the condensation zone, are also wetted with operating liquid, but are not "dropped on" directly. Due to the energetically very strong processes in the condenser, drops are sputtered out of the condensation zone, wherein said drops are still used in the lower boundary of the lateral vapor introduction zone to further improve the efficiency of the condenser.

In an advantageous embodiment of the present invention, the vapor feed from the evaporator is made through the condenser, wherein a compressor wheel is located at least partly above the condensation zone, but separate from the condensation zone. The geometrical design of the suction zone of the compressor and the arrangement of the compressor above the evaporator cause the vapor to be drawn upwards. The vapor is then compressed in the compressor itself, which is advantageously implemented as a radial wheel. However, using the radial wheel at the same time results in the vapor to be redirected laterally/outwards. This means that redirecting by 90 degrees takes place already above the condensation zone. By means of another redirection by 90 degrees, which may be implemented easily and, in particular, in a compact manner, the compressed vapor is then introduced into the vapor introduction zone and, from there, reaches the condensation zone to be condensed there and discharge its energy, by the condensation, to the operating liquid in the condenser.

The feed of the liquid into the condensation zone advantageously takes place such that the liquid already comprises a "spin" when introduced at the top of the condensation zone. This ensures the liquid by itself to flow over the perforated plate above the condensation zone from the inlet within the perforated plate outwards, due to the spin induced by the geometric design of the inlet, such that a fast, efficient and even supply of the condensation zone with a trickling liquid is ensured.

All these measures result in an efficient condenser which, despite its relatively small volume, has a high condenser performance. Thus, a heat pump of small dimensions and considerable performance can be obtained.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
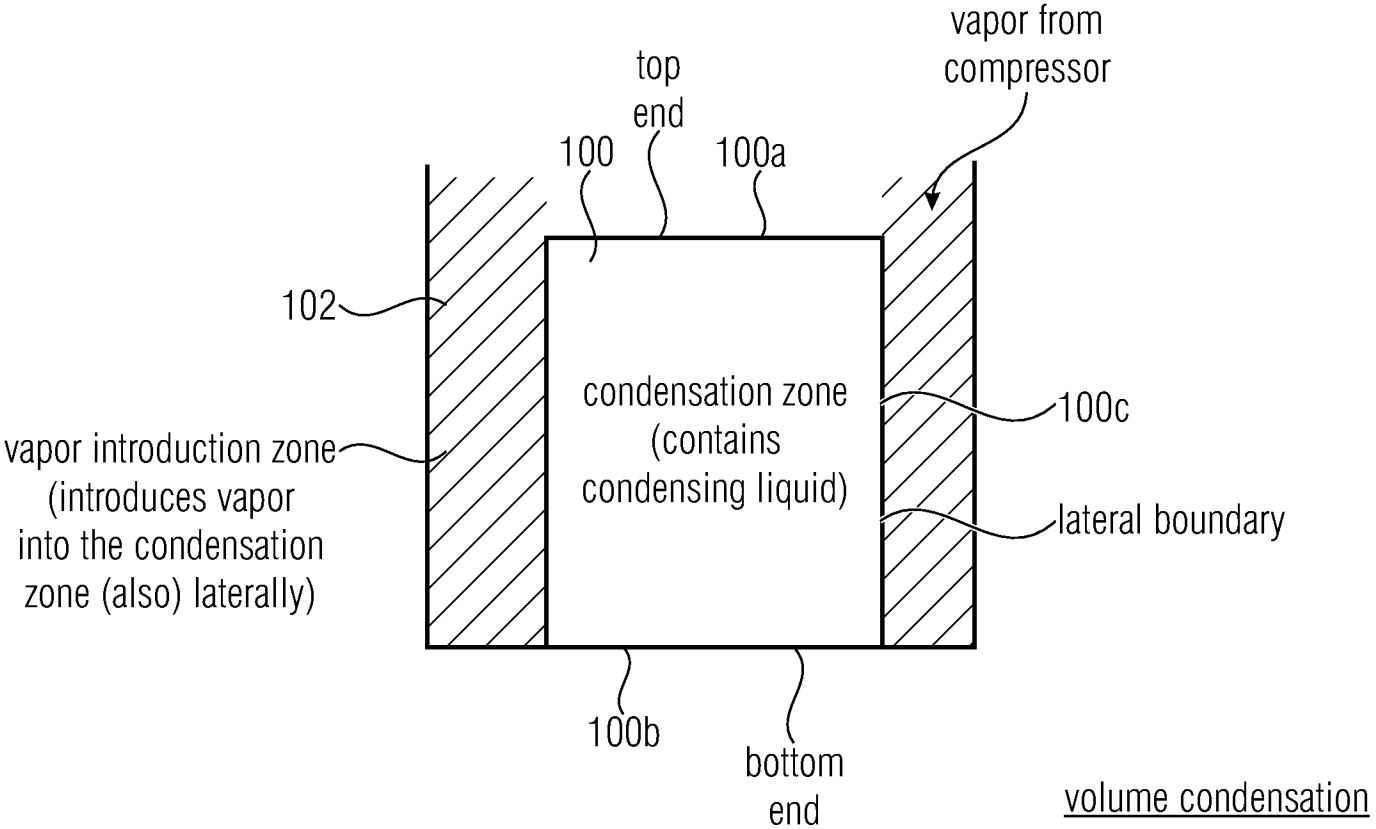
FIG. 1 is a schematic illustration of a condenser including a condensation zone and a vapor introduction zone.

FIG. 1 shows a schematic condenser in accordance with an embodiment of the present invention.

The condenser includes a condensation zone 100 for condensing vapor to be condensed in an operating liquid, the condensation zone being formed as a volume zone. In particular, the condensation zone includes a top end 100*a*, a bottom end 100*b* and a lateral boundary 100*c*. The lateral boundary is arranged between the top and bottom ends. The condenser additionally includes a vapor introduction zone 102 which extends along the lateral ends 100*c* of the condensation zone 100 and is configured to feed vapor to be condensed into the condensation zone 100 laterally via the lateral boundary 100*c* of the condensation zone 100. In an advantageous embodiment, which is discussed exemplarily making reference to FIG. 2, the condensation zone is cylinder-shaped on the one hand and, on the other hand, the vapor introduction zone is configured to be a ring cylinder which is hollow inside, the hollow inside of the vapor introduction zone being formed by the condensation zone. Both the condensation zone and the vapor introduction zone, however, need not necessarily be of a ring-shaped cross-section, but may exhibit any other shape in cross-section, such as, for example, an elliptical shape or another rounded shape. The condensation zone and the vapor introduction zone may even be of an angular cross-section, depending on the implementation of the outer boundary that may be used, although a round shape and, in particular, a round shape with, in cross-section, circular boundaries is advantageous.

Furthermore, it is advantageous to implement the condensation zone such that the area of the lateral boundary of the condensation zone is larger than an area of the top or bottom boundary. Thus, the shape of the condensation zone may be cylindrical or cuboid, the height advantageously being greater than a diameter or diagonal, etc.

Also illustrated in FIG. 1 is the fact that the vapor introduction zone extends completely laterally around the condensation zone. This complete extension of the vapor introduction zone around the condensation zone is advantageous since this allows making optimum use of the volume condensation in the volume condensation zone. However, at the same time, due to the lateral vapor introduction into the condensation zone, condensation takes place in a transverse flow direction in that the vapor entering the condensation zone, on the one hand, and the movement of the condensing liquid in the condensation zone, on the other hand, are directed to be neither parallel nor anti-parallel, but form an angle to each other which is advantageously in the region of 90 degrees, wherein already with angles between 10 degrees and 170 degrees, a considerable improvement compared to a parallel orientation may be achieved. The region around 90 degrees, advantageously extending from 60 to 150 degrees, is advantageous particularly, wherein these indications of degrees show the angle of the vapor flow direction on the one hand and the liquid movement direction on the other hand in or at the edge of the condensation zone. The vapor introduction zone consequently does not have to extend completely around the lateral edge of the condensation zone, but may exemplarily include only half of or a certain sector of the lateral boundary of the condensation zone, however a complete circumference is advantageous.

Figure 2:
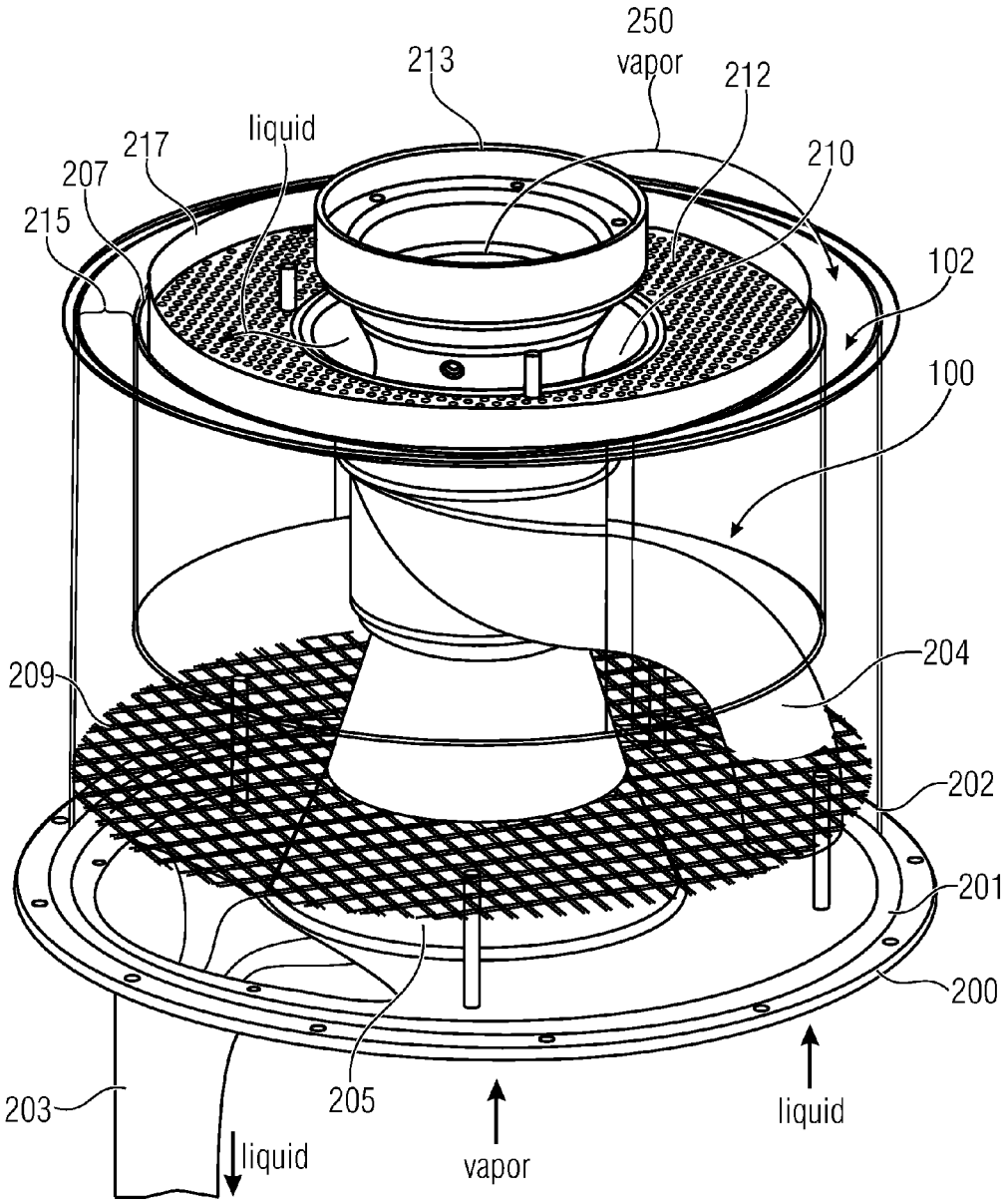
FIG. 2 is a perspective illustration of an essential part of a condenser in accordance with an embodiment of the present invention.

FIG. 2 shows an advantageous embodiments of a condenser, the condenser in FIG. 2 comprising a vapor introduction zone 102 extending completely around the condensation zone 100. Particularly, FIG. 2 shows a part of the condenser which comprises a condenser base 200. Arranged on the condenser base is a condenser casing portion 202 which, for the sake of illustration, is indicated to be transparent in FIG. 2 which, however, need not necessarily be transparent, but may exemplarily be formed of plastic, aluminum die cast or the like. The lateral casing part 202 rests on a washer 201 so as to achieve good sealing with the base 200. Additionally, the condenser includes a liquid outlet 203 and a liquid inlet 204, and a vapor feed 205, arranged in the center of the condenser, which tapers from the bottom to the top in FIG. 2. It is pointed out that FIG. 2 represents the actually desired setup direction of a heat pump and a condenser of this heat pump, wherein in this setup direction in FIG. 2 the evaporator of a heat pump is arranged below the condenser. The condensation zone 100 is limited outwards by a cage-like boundary object 207 which is also indicated to be transparent, as is the outer casing part 202, and is normally implemented to be cage-like.

Figure 6:
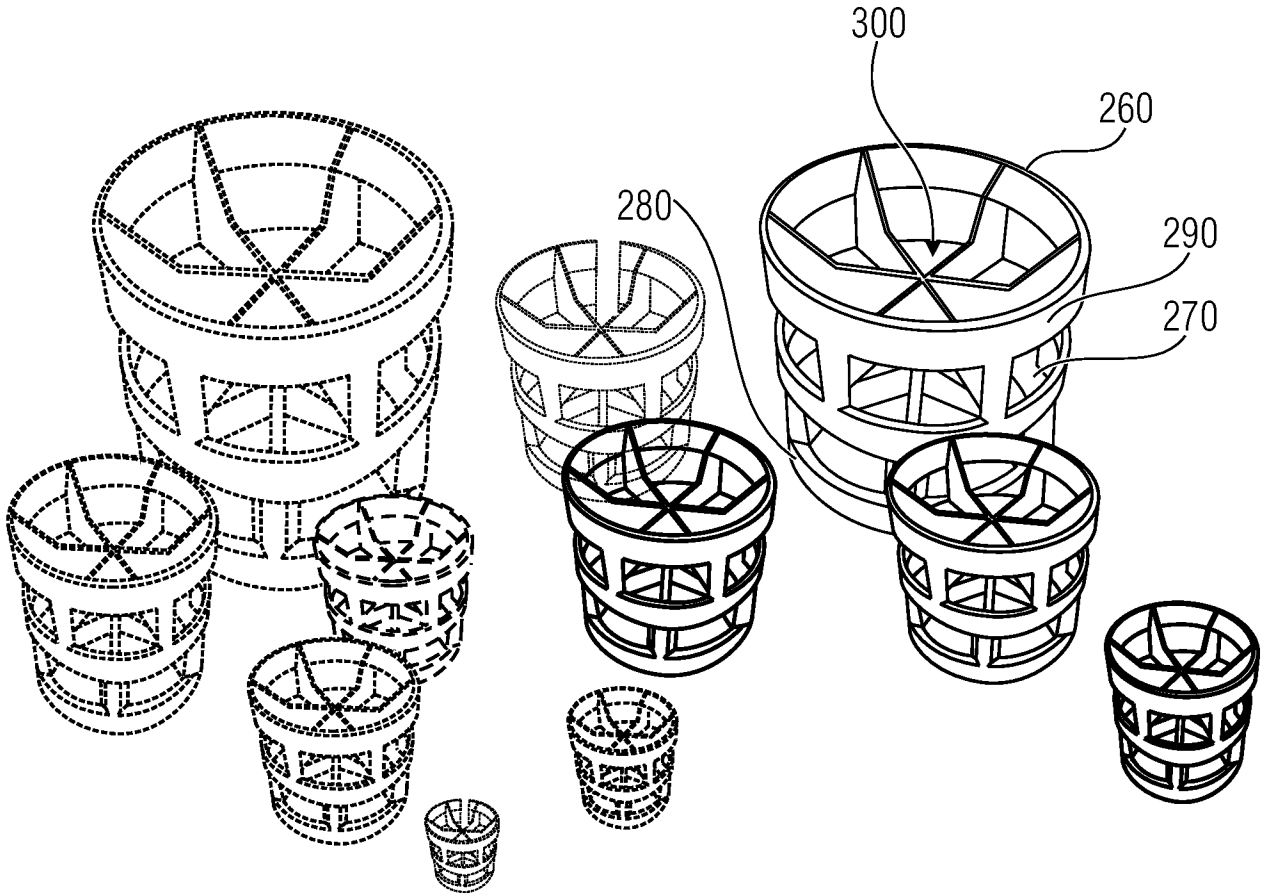
FIG. 6 is an illustration of Pall rings as advantageous dumped elements of different sizes and shapes.

Additionally, there is a grating 209 configured to support fillers not shown in FIG. 2. As can be seen from FIG. 2, the cage 207 extends downwards only up to a certain point. The cage 207 is provided to be permeable to vapor to hold fillers, such as, for example, Pall rings, as are illustrated in FIG. 6. These fillers are introduced into the condensation zone, only within the cage 207, but not in the vapor introduction zone 102. However, the fillers are filled to the same height outside the cage 207 such that the height of the fillers extends either to the lower boundary of the cage 207 or somewhat beyond.

The result is a situation, as is exemplarily illustrated in FIG. 4*b*, wherein the fillers 208 within the cage 207 extend up to a certain height, whereas the fillers in the vapor introduction zone and below extend only up to a lower height, which is indicated schematically at 209. Thus, the vapor introduction zone or vapor inlet zone is limited downwards since condensation takes place in the region where the turbulence generators or fillers are dumped up to the height 209, due to the drops sputtered therefrom by the condensation in the condensation zone and flying to the fillers which form the lower end of the vapor inlet zone and condense with the vapor which has "reached" the bottom end of the vapor introduction zone, i.e. the height 209, and has not been "sucked off" before by the actual condensation zone and, in particular, the conditions there, such as, for example, water trickling down.

The condenser of FIG. 2 includes an operating liquid feeder which is formed in particular by the operating liquid feed 204 which, as is shown in FIG. 2, is arranged to be wound around the vapor feed in the form of an ascending winding, by a liquid transport region 210 and by a liquid distributor element 212 which is advantageously formed as a perforated plate. In particular, the operating liquid feeder is configured to feed the operating liquid to the condensation zone.

In addition, a vapor feeder is provided which, as is shown in FIG. 2, is advantageously made up of the funnel-shaped tapering feeding region 205 and the top vapor guiding region 213. A wheel of a centrifugal compressor is advantageously used in the vapor guiding region 213, centrifugal compression resulting in vapor being sucked from the bottom to the top by the feed 205 and then being redirected outwards by the radial wheel already by 90 degrees, due to centrifugal compression, i.e. from a bottom-to-top flow to a flow from the center outwards relative to the element 213 in FIG. 2.

Not shown in FIG. 2 is another redirector which redirects the vapor already redirected outwards again by 90 degrees to then guide same into the gap 215 from the top, which represents the beginning of the vapor introduction zone which extends laterally around the condensation zone. The vapor feeder is thus advantageously configured to be ring-shaped and provided with a ring-shaped gap for feeding the vapor to be condensed, the operating liquid feed being formed within the ring-shaped gap.

Figure 3:
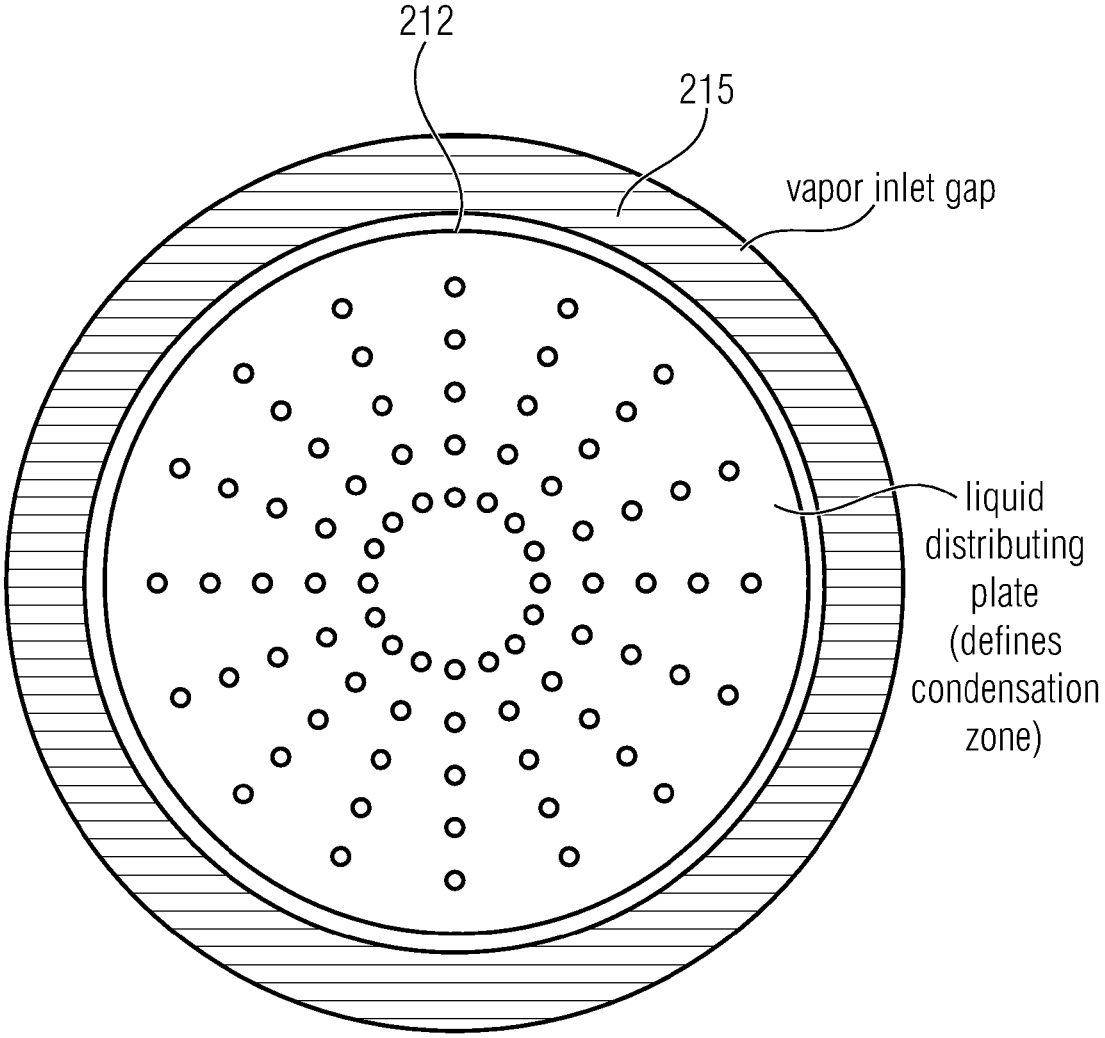
FIG. 3 is an illustration of the liquid distribution plate on the one hand and the vapor inlet zone including a vapor inlet gap on the other hand.

Reference is made to FIG. 3 for illustration purposes. FIG. 3 shows a bottom view of the "lid region" of the condenser of FIG. 2. In particular, the perforated plate 212 is illustrated schematically from below, acting as the liquid distributing element. The vapor inlet gap 215 is illustrated schematically, the result from FIG. 3 being that the vapor inlet gap is only implemented in a ring-shaped manner such that vapor to be condensed is not fed into the condensation zone directly from the top or directly from the bottom, but only extending laterally. Only liquid, but no vapor flows through the holes of the distributing plate 212. At first, the vapor is "sucked" into the condensation zone laterally, due to the liquid having passed through the perforated plate 212. The liquid distributor plate may be made of metal, plastic or a similar material and may be implemented using different hole patterns. In addition, as is shown in FIG. 2, a lateral boundary for the liquid flowing from the element 210 is advantageously provided, this lateral boundary being referred to by 217. This ensures that liquid which exits from the element 210 exhibiting a spin, due to the curved feed 204, and distributes on the liquid distributor from the center outwards, does not spill over the edge into the vapor introduction zone provided that the liquid has not already dripped through the holes of the liquid distributor plate and condensed with vapor.

Figure 4A:
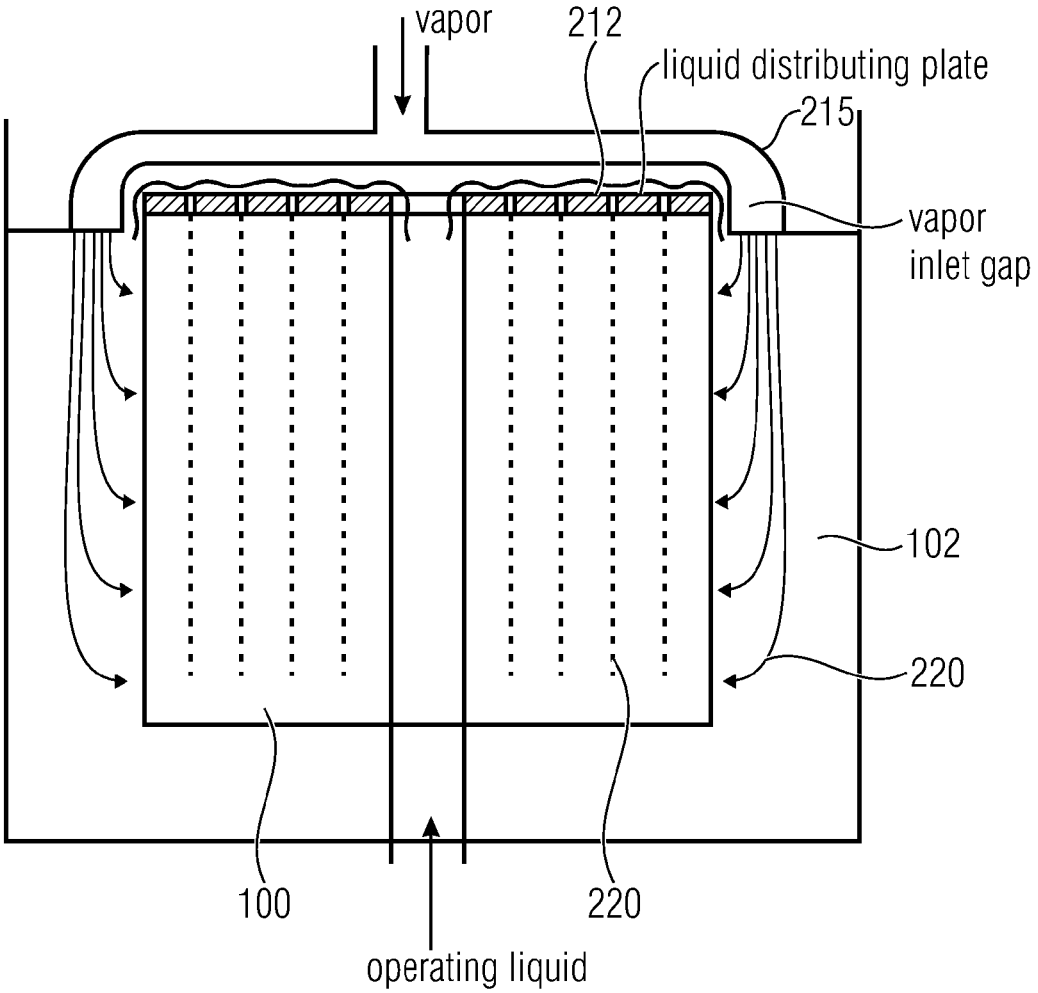
FIG. 4*a* is a schematic illustration of volume condensation including cross-flowing between the vapor and the liquid.

FIG. 4*a* shows an alternative implementation of the condenser in which the operating liquid is fed from below and the vapor is fed from above. The inventive condenser may also be employed for counter-flow feeding of vapor and operating liquid, since, in the vapor introduction zone 102, the vapor is directed automatically into the condensation zone 100 so as to achieve transverse flow volume condensation. In particular, FIG. 4*a* again illustrates a distributor plate 212 in cross-section. In addition, an operating liquid is fed onto the distributor plate 212, wherein the liquid then enters the condensation zone through the holes of the distributor plate in the form of droplets 220 and in the end is responsible for the condensation zone exhibiting a condensation functionality. Vapor is fed to the drops present in the condensation zone via the vapor inlet gap which may exemplarily be implemented in the form of the inlet gap 215 of FIG. 3, and the vapor is redirected, due to the condensation partner being present in the form of the liquid, within the condensation zone, as is indicated by the curved vapor flow directions 220.

FIGS. 2 and 1 and 4*a* illustrate a condenser in which the condensation zone is not filled. However, the condensation zone is advantageously filled with fillers 208, as is illustrated in FIG. 4*b*. These fillers serve as turbulence generators within the condensation zone since they cause turbulence in the operating liquid heated by condensation, redirecting and mixing same, such that a vapor particle ready for condensation will possibly usually find a cooler region of a condensation liquid so as to condense efficiently, i.e. to transfer its energy onto same. Advantageously, the cage 207 is filled with fillers to the top or up to a certain height, as is schematically illustrated in FIG. 4*b*, whereas the lateral region is filled only up to the height 209 such that the vapor inlet zone will result in the lateral region above the height 209, as is indicated schematically in FIG. 4*b*.

It has been shown making reference to FIG. 4*a* that the operating liquid feed advantageously is implemented such that the drop-shaped operating liquid passes the condensation zone, due to gravity, from the top to the bottom with regard to gravity.

In addition, the operating liquid feed comprises a pipe for providing the operating liquid from the bottom to the top, and the distributor plate 212 which is mounted to a pipe end in order to distribute the operating liquid over the entire top end of the condensation zone, the distributor plate 212 comprising openings which are implemented such that an operating liquid flowing on the distributor plate penetrates these openings and trickles into the condensation zone over an area.

The condenser casing extends, as is exemplarily shown in FIG. 2, around the interior region, i.e. around the condensation zone which is limited by the cage 207, wherein, however, the vapor inlet gap 215 which represents the vapor introduction zone is provided between the boundary 207 and the casing.

Figure 4B:
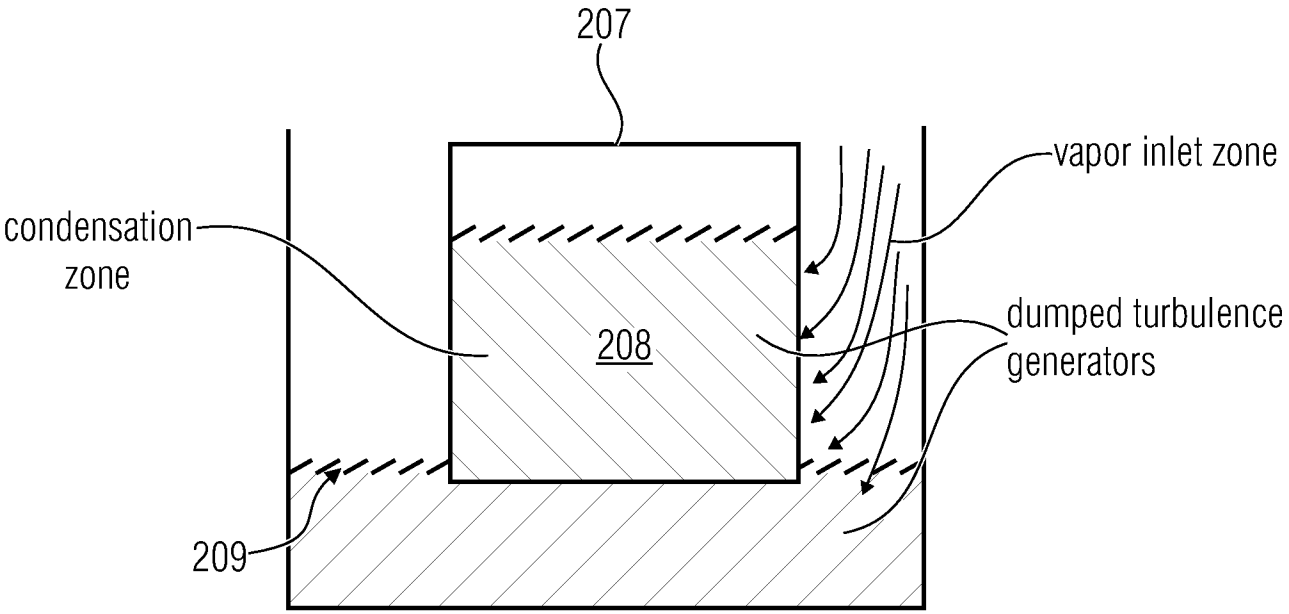
FIG. 4*b* is a schematic illustration of a section through the condenser including dumped turbulence generators, such as, for example, Pall rings.

In addition, as has been illustrated making reference to FIG. 4*b*, objects are arranged in the limited area which are wetted by the operating liquid moving through the condensation zone, the objects being implemented such that turbulence is caused in the wetted operating liquid, and these objects not being arranged in the vapor introduction zone.

The objects include dumped individual plastic parts which are arranged on top of one another such that the liquid on the one hand and the vapor to be condensed on the other hand are able to move between the objects.

Particularly, the region or condensation zone is limited by the cage 207 which keeps the objects in the condensation zone and away from the vapor introduction zone. In one embodiment of the present invention, the diameter of the entire condenser is in the range of 400 mm. However, efficient condensers with diameters between 300 mm and 1000 mm may also be produced.

Figures 5A, 5B:
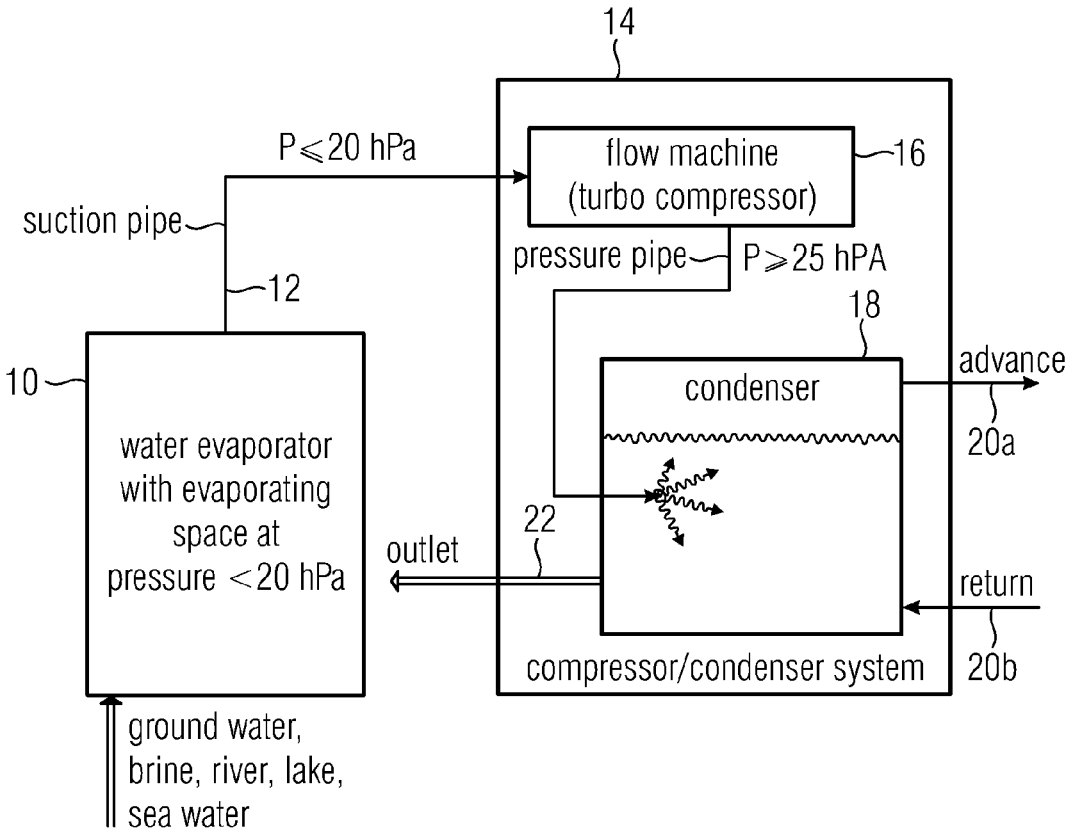
FIG. 5*a* is a schematic illustration of a known heat pump for evaporating water.
FIG. 5*b* shows a table for illustration of pressures and evaporating temperatures of water as an operating liquid.

A heat pump comprising a condenser in particular includes an evaporator for evaporating an operating liquid, as is exemplarily illustrated in FIG. 5*a*, water being the advantageous operating liquid for the present invention. Additionally, a compressor 16 for compressing operating liquid evaporated in the evaporator is provided, and additionally the condenser 18 of FIG. 5*a* is implemented in a way as has been illustrated in FIGS. 1 to 4*b*. Advantageously, the vapor introduction zone of the condenser, i.e. the region 102, is connected to an output of the compressor. In addition, the condenser is arranged downstream of the evaporator, and a suction line of the compressor which tapers in cross-section from the bottom to the top extends through the condenser, as is shown in FIG. 2 at 205.

Additionally, the compressor includes a radial wheel which is arranged at least partly above the condensation zone and separate from the condensation zone. In particular, this radial wheel is configured to be introduced into the region 213 of FIG. 2. Finally, the output of the compressor is arranged above the condensation zone, as has exemplarily been illustrated in FIG. 4*a* and as is also implemented in FIG. 2 by placing a "lid" comprising another 90-degree vapor inlet on top of it. As has been mentioned, this is how the vapor is redirected from a lateral flow direction to a flow direction directed downwards. The path of the vapor is thus implemented such that the vapor is at first sucked by the evaporator upwards vertically, redirected laterally by the centrifugal compressor and then redirected again by 90 degrees by the "lid" exemplarily illustrated in FIG. 3 from below so as to be introduced into the vapor inlet gap, as is particularly illustrated in FIG. 2 by an arrow 250.

FIG. 6 shows so-called Pall rings as advantageous implementations of the fillers. These feature the characteristic of comprising a certain volume, but not filling said volume completely, like, for example, full-volume cylinders or the like do, but only filling said volume without, however, preventing water on the one hand and vapor on the other hand from passing. Thus, Pall rings comprise circular bridges 260, 270, 280 connected to one another via vertical bridges 290. Additionally, the vertical bridges 290 are connected in a star-like manner, as is shown by the element 300 which all in all represents such a star which, on the one hand, includes the vertical bridges 290 and, on the other hand, a connection of said vertical bridges in the center.

However, hollow cylinders, hollow cuboids or similar elements may also be used which occupy a certain volume but leave a relatively large amount of space such that various edges and bridges are present. These edges and bridges serve for operating liquid passing through these fillers to be continuously exposed to turbulence and vortexing such that a warm region of an operating liquid droplet, for example, which has just been condensed, is again exposed to turbulence such that the coldest possible region of the operating liquid presents itself for each vapor particle willing to condense.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A condenser comprising:

a condensation zone for condensing vapor to be condensed in an operating liquid, the condensation zone being implemented as a volume zone comprising a top end, a bottom end and a lateral boundary between the top end and the bottom end;

a vapor introduction zone which extends along the lateral end of the condensation zone and is configured to feed vapor to be condensed into the condensation zone laterally via the lateral boundary; and a condenser casing, wherein a region in the condenser casing is limited by a cage-like boundary object spaced apart from the condenser casing by the vapor introduction zone, and wherein the condensation zone is arranged in the region limited by the cage-like boundary object.

2. The condenser in accordance with claim 1, further comprising:

an operating liquid feeder configured to feed the operating liquid to the condensation zone; and a vapor feeder configured to feed the vapor to be condensed into the vapor introduction zone.

3. The condenser in accordance with claim 2, wherein the vapor feeder comprises an all-around gap for feeding the vapor to be condensed, wherein the operating liquid feed is formed in a region surrounded by the all-around gap.

4. The condenser in accordance with claim 1, wherein the operating liquid feed is configured such that drops of the operating liquid pass the condensation zone, due to gravity, from the top to the bottom relative to the direction of gravity.

5. The condenser in accordance with claim 4, wherein the operating liquid feed comprises a pipe for providing the operating liquid from the bottom to the top, and a distributor plate mounted to an end of the pipe so as to distribute the operating liquid over the entire top end of the condensation zone, wherein the distributor plate comprises openings configured such that operating liquid flowing on the distributor plate penetrates the openings and reaches the condensation zone over an area.

6. The condenser in accordance with claim 1, wherein objects which are wetted by the operating liquid moving through the condensation zone are arranged in the region bound by the boundary, the objects being configured such that turbulence is caused in the wetting operating liquid, and the objects not being arranged in the vapor introduction zone.

7. The condenser in accordance with claim 6, wherein the objects are formed by dumped individual parts which are arranged on top of one another such that the operating liquid and the vapor to be condensed are able to move between the objects.

8. The condenser in accordance with claim 1, wherein the boundary comprises a cage holding the objects in the condensation zone and separate from the vapor introduction zone.

9. The condenser in accordance with claim 1, wherein the condensation zone is cylindrical, and the vapor introduction zone is circular and extends around the cylindrical condensation zone.

10. The condenser in accordance with claim 9, wherein the condensation zone comprises a cylindrical bottom region comprising an outer diameter equaling an outer diameter of the vapor introduction zone, wherein the condensation zone further comprises a cylindrical core region, the outer diameter of which is smaller than the outer diameter in the bottom region, and wherein the vapor introduction zone and the core region extend such that the vapor introduction zone comprising the core region and the bottom region of the condensation zone comprises a cylinder limited laterally by a condenser casing.

11. The condenser in accordance with claim 6, further comprising a bottom grating on which the objects are arranged, a condenser outlet being arranged below the bottom grating in the setup direction so as to withdraw from the condenser operating liquid heated by condensation.

12. The condenser in accordance with claim 2, wherein the operating liquid feed is configured to feed the operating liquid onto a perforated distributor plate in a rotating manner such that the operating liquid on the perforated plate is distributed from the center outwards due to the rotating feeding.

13. The condenser in accordance with claim 1, wherein a compressor is formed above the condensation zone at a compressor feed, the compressor feed extending within the condensation zone, wherein the compressor is formed as a centrifugal compressor, and further vapor redirecting unit is formed at an output of the compressor so as to feed the compressed vapor downwards into the vapor introduction zone.

14. The condenser in accordance with claim 1, wherein fillers are arranged within the condensation zone, and wherein at least in a part of the vapor introduction zone, there are no fillers.

15. The condenser in accordance with claim 14, wherein the fillers are formed as Pall rings.

16. A method of using a condenser in accordance with claim 1, wherein a flow of operating liquid takes place in the condensation zone in an advantageous direction and wherein operating liquid vapor enters into the condensation zone from the vapor introduction zone in a cross-flow manner, wherein a flow direction of the operating liquid vapor forms an angle with regard to the advantageous direction of the operating liquid flow which is greater than 10 degrees and smaller than 170 degrees.

17. A method for manufacturing a condenser, comprising:

providing a condensation zone for condensing vapor to be condensed in an operating liquid, the condensation zone being implemented as a volume zone comprising a top end, a bottom end and a lateral boundary between the top end and the bottom end;

arranging a vapor introduction zone along the lateral end of the condensation zone so that vapor to be condensed is fed into the condensation zone laterally via the lateral boundary and wherein a region in a condenser casing is limited by a cage-like boundary object spaced apart from the condenser casing by the vapor introduction zone, and wherein the condensation zone is arranged in the region limited by the cage-like boundary object.

18. A heat pump comprising:

an evaporator for evaporating operating liquid;

a compressor for compressing operating liquid evaporated in the evaporator; and a condenser in accordance with claim 1, the vapor introduction zone being connected to an output of the compressor.

19. The heat pump in accordance with claim 18, wherein the condenser is arranged upstream of the evaporator, wherein a suction line of the compressor extends through the condenser, wherein a radial wheel of the compressor is arranged at least partly above the condensation zone, and wherein an output of the compressor is arranged above the condensation zone.

20. The heat pump of claim 18, wherein the condenser is formed in a cylindrical casing and arranged above the evaporator, wherein both the evaporator and the condenser are of the same outer diameter.

* * * * *